United States Patent [19]

Bale et al.

[11] Patent Number: 4,969,476

[45] Date of Patent: Nov. 13, 1990

[54] SMOKING ARTICLE

[75] Inventors: Christopher R. Bale, Keynsham; Beresford R. Gill, Portishead; Brian C. Chard, Bristol; Stephen J. Garrett, Somerton, all of England

[73] Assignee: Imperial Tobacco Limited, Bristol, England

[21] Appl. No.: 97,477

[22] Filed: Sep. 16, 1987

[30] Foreign Application Priority Data

Sep. 19, 1986 [GB] United Kingdom ..... 8622606

[51] Int. Cl.[5] ..... A24D 1/02; A24D 1/18

[52] U.S. Cl. ..... 131/336; 131/194; 131/195; 131/359; 131/360

[58] Field of Search ..... 131/359, 360, 364, 336, 131/194, 195, 335

[56] References Cited

U.S. PATENT DOCUMENTS 4,474,191 10/1984 Steiner ..... 131/198.2

*Primary Examiner*—V. Millin

*Attorney, Agent, or Firm*—Larson & Taylor

[57] ABSTRACT

An elongate smoking article for releasing an aerosol into the mouth of a smoker comprises, a fuel rod having a light-up end adapted to be lit by a smoker; a tube extending from the fuel rod to a mouth end of the article thereby defining a condensation chamber between the fuel rod and the mouth end of the article; ventilation means to permit the passage of ventilating air from the light-up end of the fuel rod to the condensation chamber, and a porous ceramic cylindrical element impregnated with an aerosol precursor surrounding the fuel rod and in intimate contact with at least a portion thereof. A permeable fire-proof sheath surrounds the ceramic element, the sheath being adapted to provide physical integrity of the whole assembly, to allow the inward diffusion of air to maintain and propagate combustion of the fuel rod and to allow outward diffusion of combustion products.

15 Claims, 2 Drawing Sheets

SMOKING ARTICLE

The present invention concerns improvements in or relating to a smoking article. Among the reasons why many people smoke conventional cigarettes is that they wish to inhale an aerosol that contains nicotine. However, when a cigarette is smoked, not only is some nicotine lost to the smoker by pyrolysis and to sidestream smoke during smoulder between puffs but undesirable substances such as carbon monoxide and noxious tars are inhaled. The present invention provides a smoking article in which the above disadvantages are at least substantially avoided.

A prior art smoking article which aims at avoiding the above-mentioned disadvantages is described in U.S. Pat. No. 3,356,094 in the name of C. D. Ellis et al. This smoking article comprises a tube formed of tobacco having a mouthpiece attached at one end. An axial inner tube of material which is frangible under heat is contained within the tobacco tube and is coated on its inner surface with nicotine. Thus, on smoking, hot gases are drawn up the inner tube and, acting on the nicotine, release the nicotine in the form of an aerosol for inhalation by the smoker. However, with the smoking article of U.S. Pat. No. 3,356,094 there is an appreciable loss of nicotine and other desirable compounds such as flavourants during smouldering.

A further prior art smoking article described in European Patent Application No. 174645 (R. J. Reynolds Tobacco Company) comprises a short combustible carbonaceous fuel element, a heat stable substrate bearing an aerosol forming substance (aerosol generating means), a heat conducting member which contacts a portion of the fuel element and the substrate, and an insulating jacket surrounding at least a portion of the fuel element, the object being to provide an aerosol "smoke" which is chemically simple, consisting essentially of air, oxides of carbon, water, and the aerosol which carries any desired flavourants or other desired volatile materials. A disadvantage of the smoking article of E.P.A. No. 174645 is that the aerosol generating means is maintained at a relatively high temperature during and between puffs and thus the user's ingestion of aerosol would not be puff dependent and controllable by the user. Further disadvantages are an exposed burning fuel element, complexity, and resulting difficulty in manufacture of the article.

According to the present invention there is provided an elongate smoking article for releasing an aerosol into the mouth of a smoker, the article comprising, (a) a rod-like fuel element having a light-up end adapted to be lit by a smoker;

(b) a cylindrical element surrounding the fuel element and in intimate contact with at least a portion of the fuel element, the cylindrical element comprising an inert substrate impregnated with an aerosol precursor;

(c) a tube extending from the fuel element to a mouth end of the article thereby defining a condensation chamber between the fuel element and cylindrical element and the mouth end of the article; and, (d) ventilation means to permit the passage of ventilating air from the light-up end of the fuel element to the condensation chamber.

Preferably, there is provided a permeable fire-proof sheath surrounding the inert substrate. The fire-proof sheath surrounds the substrate so to provide physical integrity of the whole assembly, to allow the inward diffusion of air to maintain and propagate combustion of the fuel element and to allow outward diffusion of combustion products.

The ventilation means is preferably provided by at least one open-ended longitudinal channel defined between the fuel element and the cylindrical element, and extending from the light-up end of the fuel element towards the mouth end of the article.

The fuel element is preferably composed predominantly of a carbonaceous fuel. "Carbonaceous" in the context of the invention will be understood to include elementary carbon, carbon compounds that are capable of being ignited and burned as fuel, or any combination thereof.

The invention will now be described by way of example only with reference to the accompanying diagrammatic non-scale drawings in which, FIG. 1 is a longitudinal section through a smoking article according to the invention;

Figure 1:
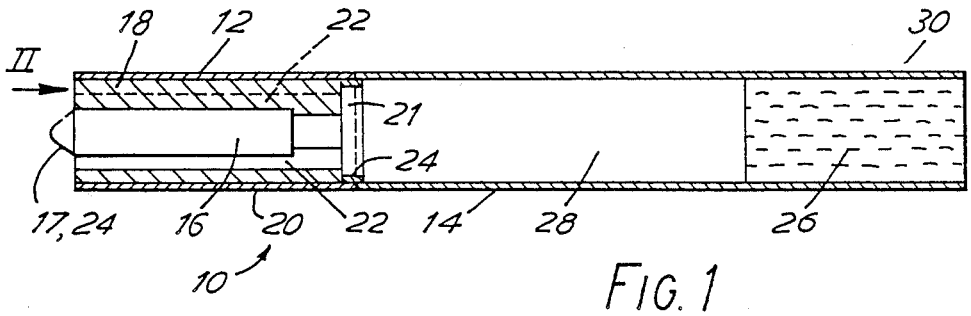
Figure 2:
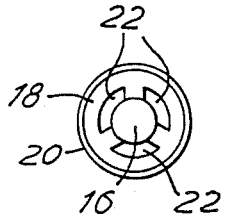
FIG. 2 is an end view of the article as seen in the direction of arrow II in FIG. 1.
Figure 3:
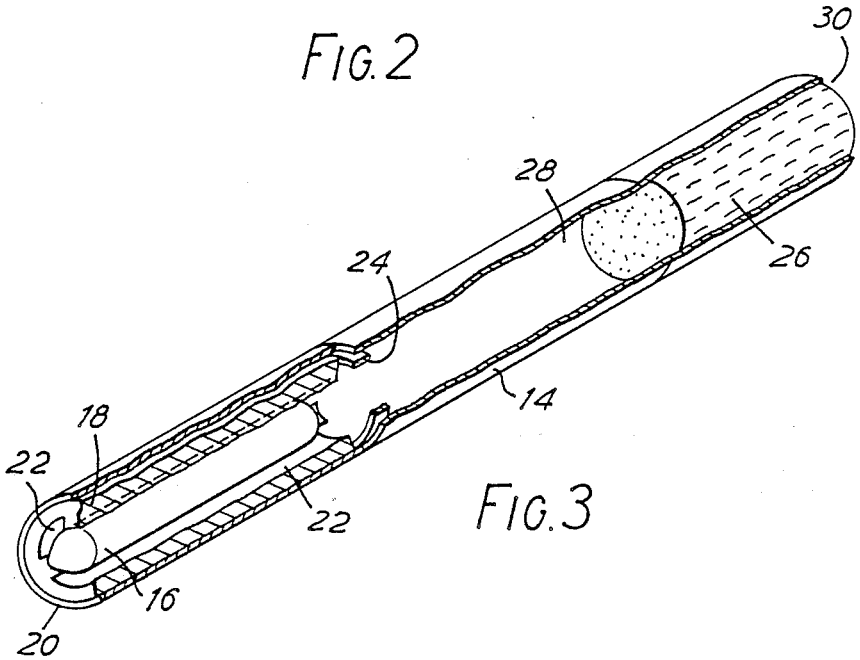
FIG. 3 is a partly cut-away oblique view of the article of FIG. 1.
Figure 4:
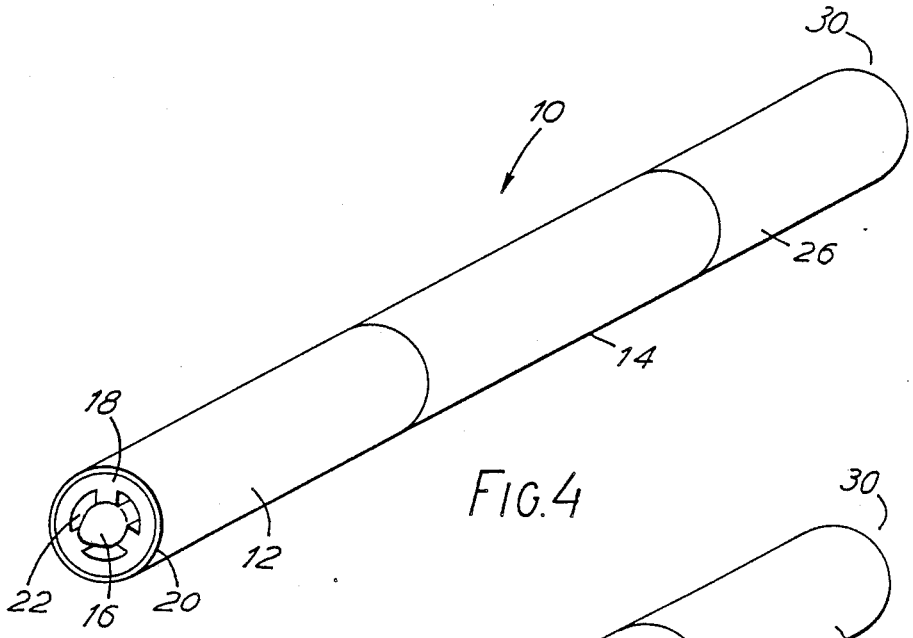
FIG. 4 is an external oblique view of the article in its integrity.

Referring to FIGS. 1 to 4, there is shown an elongate smoking article 10 comprising a cylindrical light-up end assembly 12 attached to a tube 14 of stiff cellulosic sheet material such as cardboard.

The light-up end assembly 12 consists of a rod-like carbonaceous fuel rod 16 composed of 88% carbon, 10% xanthan gum binder and 2% potassium nitrate (as oxidizing agent) embedded in an inert cylindrical substrate 18 of permeable ceramic fibre so that, except as hereinafter provided, the substrate and the fuel rod are in intimate contact. It should be understood that the above composition of the fuel rod is merely for example and is not to be taken as limiting the scope of the invention in any way.

A tapered end portion 17 of the fuel rod 16 projects longitudinally from an end of the substrate 18 so as to provide a light-up portion of the fuel rod that may be ignited by a smoker. The tapered tip of the fuel rod 16 is suitably provided with a primer so as to assist in the initial ignition of the fuel rod.

The ceramic fibre substrate 18 is impregnated with an aerosol precursor consisting of, for example, propylene glycol or gylcerol in admixture with appropriate amounts of nicotine and flavour.

The fuel element 16 and ceramic fibre substrate 18 are contained within an enwrapping permeable fire-proof sheath 20 of woven glass fibre. A cylindrical portion 21 of the sheath 20 projects beyond an end of the substrate 18 opposed to the light-up end 17 of the fuel rod 16.

Three longitudinal channels 22 lying between the fuel rod 16 and the ceramic fibre substrate 18 are defined thereby. The channels 22 are equally spaced round the longitudinal axis of the fuel rod 16 and extend from a light-up end 24 of the fuel rod to the cardboard tube 14 so that in use ventilating air may be drawn through the channels into the interior of the cardboard tube 14.

The light-up end assembly 12 is attached to the cardboard tube 14 by means of an adhesive-coated cylindrical lug 24 of cellulosic material connecting the inner face of the tube to the inner face of the aforementioned projecting portion 21 of the sheath 20.

That end of the cardboard tube 14 opposed to the light-up end assembly 12, being the mouth end 30 of the tube, is provided with a low retention smoke filter plug 26 made of cellulose acetate fibre. The tube 14 and filter plug 26 thus form a chamber 28 which acts as a condensation chamber for combustion products leaving the light-up end assembly 12.

Typical dimensions of the smoking article, which are not to be taken as limiting in any way, are 20 mm. length and 4 mm. diameter for the fuel rod 16; 25 mm. length and 8 mm. diameter for the fire-proof sheath 20; and overall dimensions of 84 mm. length and 8 mm. diameter for the entire smoking article.

In use, the fuel rod 16 is ignited in a similar manner to a cigarette and smoulders at a rate similar to the static burn rate of a cigarette. The temperature of the smouldering fuel rod 16 is typically in excess of 600 C and is sufficient to maintain and propagate the combustion process of the fuel rod. The combustion products are composed mainly of carbon dioxide, water, and low levels of carbon monoxide.

Heat is transferred from the fuel rod 16 to the surrounding inert substrate 18 and is sufficient to vaporise the precursor. The precursor condenses to form an aerosol of particle size within the range that may be inhaled. During static smouldering some of the precursors will condense in the surrounding atmosphere to give a small amount of sidestream smoke.

During puffing, the air flow through the longitudinal channels 22 in the inert substrate 18 is sufficient to increase significantly the burn rate and temperature of the fuel rod 16. The temperature of the inert substrate 18 bearing the aerosol precursor is thus increased and larger quantities of aerosol precursors are volatilised. As the hot vapours are drawn in to the condensation chamber 28 dowstream of the light-up end assembly 12 they are subject to cooling and form an aerosol which is drawn from the chamber via the low retention filter 26 to the user's mouth.

The differential temperature between smouldering and puffing allows the operation of the smoking article of the invention to be puff dependent and therefore under the control of the smoker.

With amounts of aerosol precursor in the range 50 to 200 mg, yields of wet particulate matter in excess of 7 mg in 10 puffs can be obtained.

The provision of the fire-proof permeable outer sheath 20 enables the fuel rod 16 to burn evenly by allowing the ingress of oxygen and the outward diffusion of combustion products during smouldering. The small amount of residual ash is contained within the product.

Figure 5:
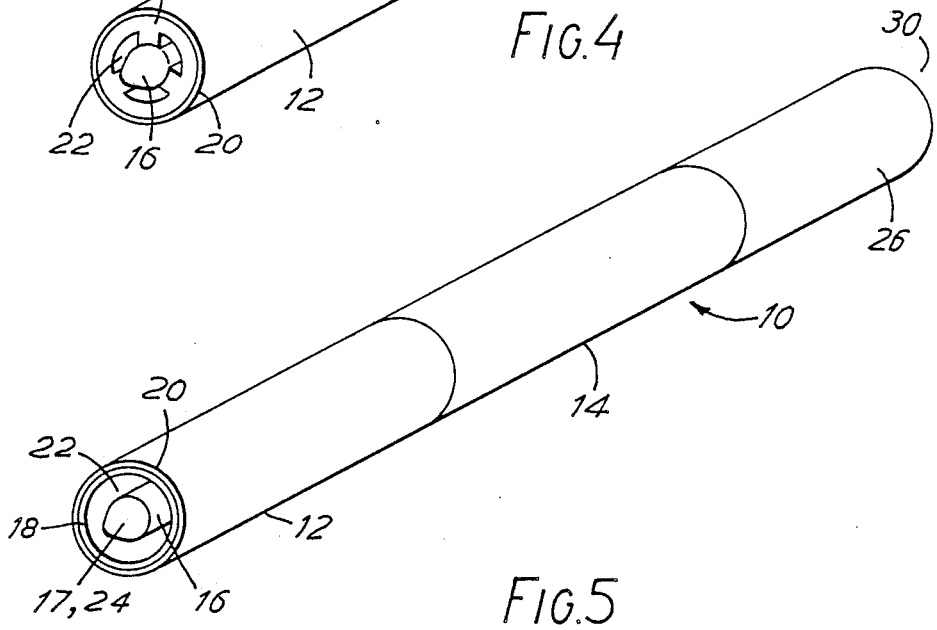
FIG. 5 is an oblique view of a second embodiment of the invention.

The embodiment of FIG. 5 shows a smoking article similar to that of the first embodiment of FIGS. 1 to 4, similar features being given the same numbers. The general structure and operation is identical to that of the first embodiment except that instead of longitudinal channels 22 between the fuel rod 16 and the substrate 18 there is provided an annular space 28.

In yet a further embodiment (not illustrated) of the invention the ventilating channels 22, instead of passing between the fuel rod 16 and the surrounding ceramic substrate 18, may pass longitudinally through the fuel rod itself or through the ceramic substrate.

What is claimed is:

1. An elongated smoking article for releasing an aerosol into the mouth of a smoker, the article comprising:

(a) a rod-like fuel-containing element having a light-up end adapted to be lit by a smoker;

(b) a cylindrical element surrounding the fuel element and in intimate contact with at least a portion of the fuel element, the cylindrical element comprising an inert substrate impregnated with an aerosol precursor;

(c) a tube extending from the fuel element to a mouth end of the article thereby defining a condensation chamber between the fuel element and cylindrical element and the mouth end of the article;

(d) ventilation means for permitting the passage of ventilating air from the light-up end of the fuel-containing element to the condensation chamber; and (e) the fuel of the fuel-containing element having along the length thereof at least one part over which ventilating air from the ventilation means is, in use of the article, drawn to promote combustion.

2. An article as claimed in claim 1 wherein there is provided a permeable fire-proof sheath surrounding the inert substrate, the sheath being adapted to provide physical integrity of the whole assembly, to allow the inward diffusion of air to maintain and propagate combustion of the fuel element and to allow outward diffusion of combustion products.

3. An article as claimed in claim 2 wherein the fire-proof sheath is made of woven glass fibre cloth, or is a porous ceramic tube.

4. An article as claimed in claim 1 wherein the ventilation means is provided by at least one open-ended longitudinal channel defined between the fuel element and the cylindrical element, and extending from the light-up end of the fuel element towards the mouth end of the article.

5. An article as claimed in claim 4 wherein the cylindrical element is in intimate contact with the fuel element except for those parts of the cylindrical element and the fuel element defining said at least one longitudinal channel.

6. An article as claimed in claim 1 wherein the ventilation means is provided by at least one longitudinal channel passing either through the fuel element itself or through the inert substrate.

7. An article as claimed in claim 1 wherein the fuel element is composed predominantly of a carbonaceous fuel.

8. An article as claimed in claim 7 wherein the fuel element includes an oxidizing agent or burn promoter, and a binder.

9. An article as claimed in claim 1 wherein the fuel element is provided with a primer including as an active principle potassium nitrate or potassium carbonate.

10. An article as claimed in claim 1 wherein the substrate is made of ceramic fibre or porous ceramic material.

11. An article as claimed in claim 1 wherein the aerosol precursor is a high boiling point ester, hydrocarbon, or polyol with a boiling point in the range 150 to 250 C in admixture with nicotine and one or more flavourants.

12. An article as claimed in claim 11 wherein the polyol is selected from the group consisting of propylene glycol and glycerol.

13. An article as claimed in claim 1 wherein the tube is made of stiff cellulosic or plastics material.

14. An article as claimed in claim 1 wherein the tube includes a smoke filter element at its mouth end.

15. An article as claimed in claim 14 wherein the filter element is made of cellulose acetate.

* * * * *